US012480726B2

(12) United States Patent
Goh et al.

(10) Patent No.: US 12,480,726 B2
(45) Date of Patent: Nov. 25, 2025

(54) FEED CHUTE ADAPTER

(71) Applicants: Justin K. Goh, Oxon Hill, MD (US); Matthew D. Lehr, King George, VA (US)

(72) Inventors: Justin K. Goh, Oxon Hill, MD (US); Matthew D. Lehr, King George, VA (US)

( * ) Notice: Subject to any disclaimer, the term of this patent is extended or adjusted under 35 U.S.C. 154(b) by 0 days.

(21) Appl. No.: 18/607,635

(22) Filed: Mar. 18, 2024

(65) Prior Publication Data

US 2025/0290716 A1 Sep. 18, 2025

(51) Int. Cl.
*F41A 9/57* (2006.01)

(52) U.S. Cl.
CPC ..... *F41A 9/57* (2013.01)

(58) Field of Classification Search
CPC ..... F41A 9/54; F41A 9/55; F41A 9/56; F41A 9/57
USPC ..... 89/33.14, 33.2, 33.5
See application file for complete search history.

(56) References Cited

U.S. PATENT DOCUMENTS

| | | | | |
|---|---|---|---|---|
| 4,662,263 | A * | 5/1987 | Titemore | F41A 9/57 89/33.14 |
| 5,461,963 | A | 10/1995 | Sanderson | 89/37.22 |
| 2012/0152094 | A1 | 6/2012 | Gonzalez | 89/33.2 |
| 2018/0058816 | A1 | 3/2018 | Geissele et al. | F41G 11/003 |
| 2022/0397358 | A1* | 12/2022 | Çorbaci | F41A 9/34 |

FOREIGN PATENT DOCUMENTS

| | | | | |
|---|---|---|---|---|
| EP | 2843350 A1 * | 3/2015 | | F41A 9/57 |
| FR | 3132755 A1 * | 8/2023 | | F41A 9/29 |

* cited by examiner

*Primary Examiner* — Bret Hayes

(57) ABSTRACT

An adapter for a belt fed firearm. The adapter includes a plate, a cutout in the plate that allows ammunition to pass through the plate, a plurality of recesses for receiving a plurality of guide lips fixed to the firearm, and a plurality of bosses for receiving a plurality of latches fixed to a feed chute.

19 Claims, 8 Drawing Sheets

FEED CHUTE ADAPTER

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to firearms. In particular, belt fed firearms.

SUMMARY

Modern militaries use various belt fed machine guns. Often these weapons are designed with for manually operated applications, where the ammunition belt is pulled directly by the gun's feed mechanism, without requiring an ammunition feed chute. Such weapons may have guide lips as a part of their design, which help the system to cope with some small misalignment between the ammunition belt and the weapon's feed mechanism.

For remotely operated applications, such as in a gun turret, the ammunition belt will need to be constrained within a flexible feed chute. The problem arises that many machine guns in common use do not include mounting points for the feed chute's latches.

A known method to address the problem is to provide a feed chute interface within the turret system. In that case the chute does not terminate directly to the gun. A bracket is placed, usually on the cradle of the turret, as close to the gun as practical to reduce the chance of a jam. The disadvantage of this is that it increases the complexity of the cradle design.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1A:
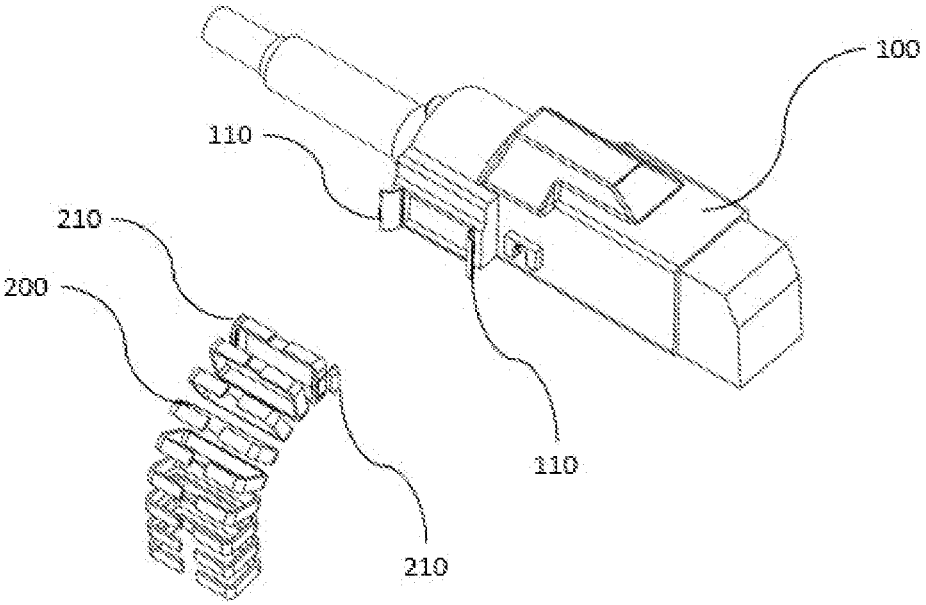
FIG. 1A shows an existing firearm 100.
Figure 1B:
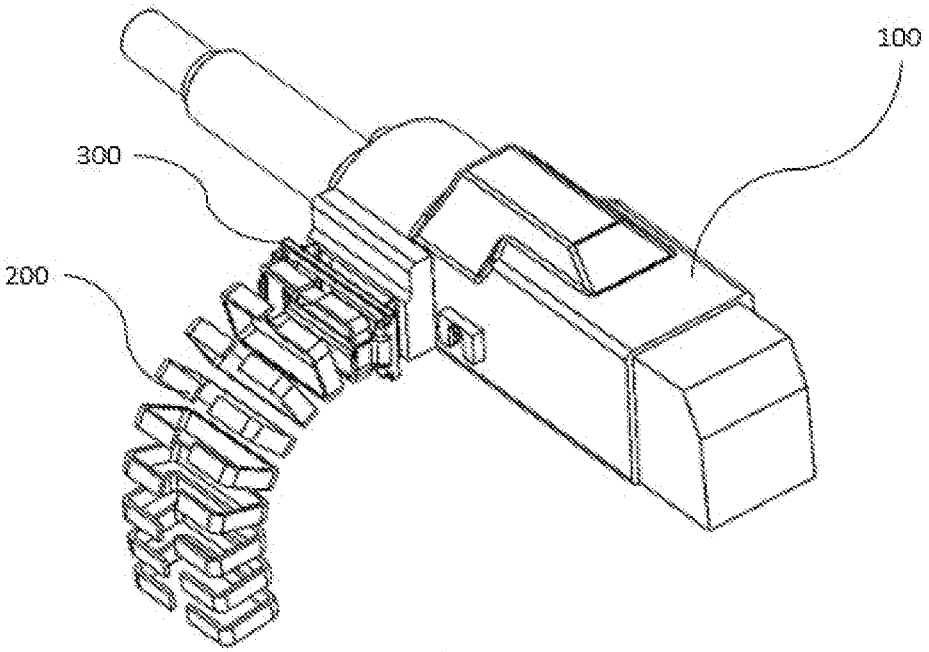
FIG. 1B shows the adapter 300 installed on firearm 100.

FIG. 1A shows an existing weapon 100 with guide lips 110 and a feed chute 200 with latches 210. FIG. 1B shows the existing weapon 100, a feed chute 200, and a feed chute adapter 300 fully assembled.

Figure 2A:
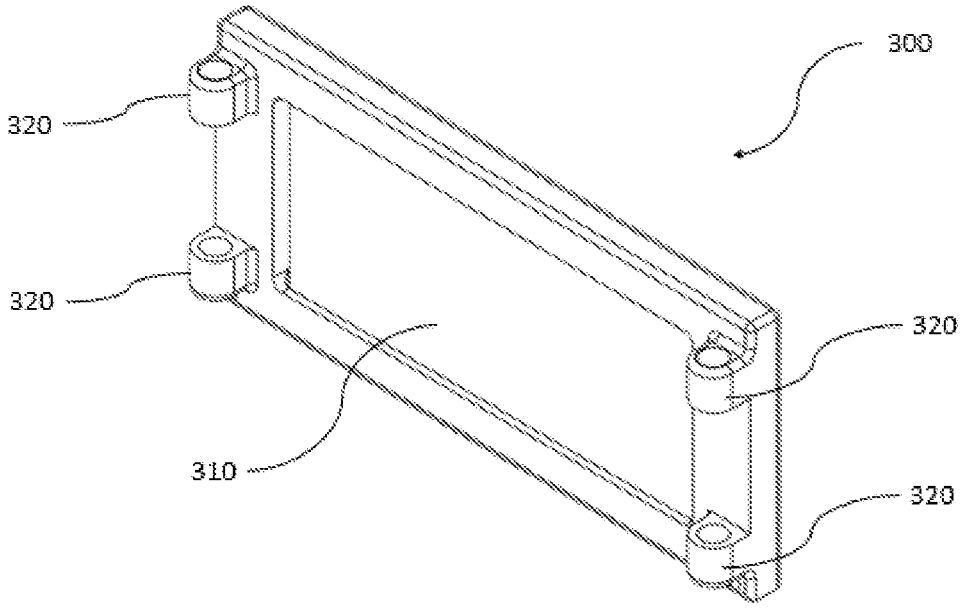
FIGS. 2A-C show various views of adapter 300.
Figure 2B:
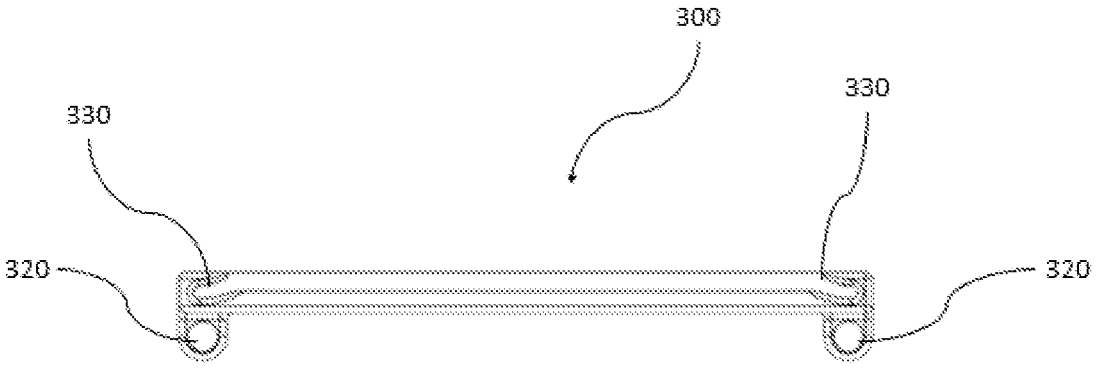
Figure 2C:
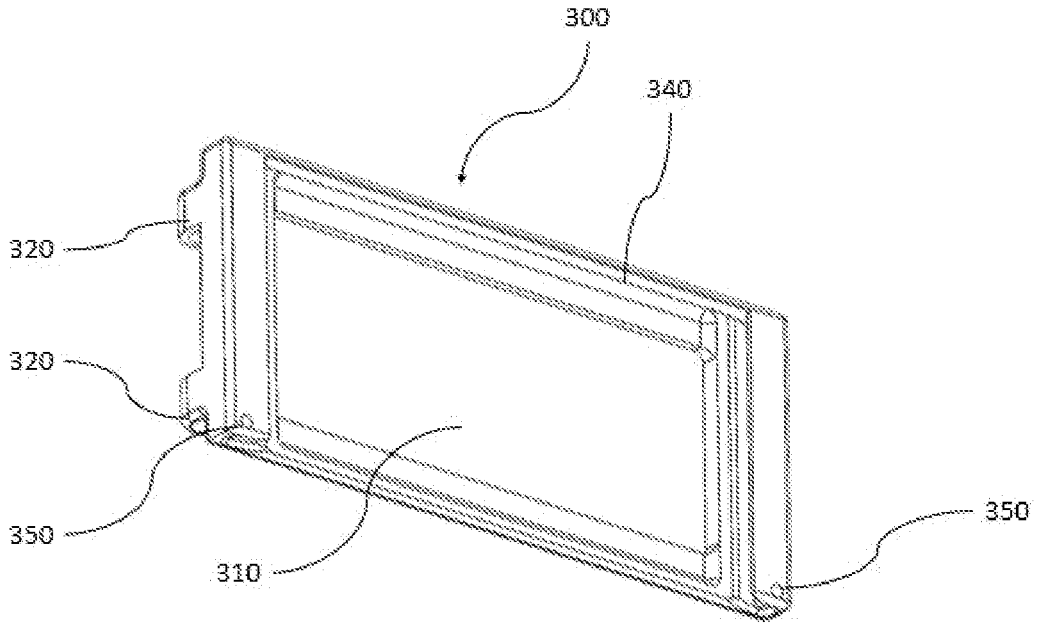

FIGS. 2A-C show an embodiment of the Feed Chute Adapter 300. In the embodiment shown, the adapter 300 is a plate with a cutout 310 in the center of the plate allows the passage of ammunition from the chute 200 to the weapon 100. One face of the adapter 300 includes four drilled bosses 320 that accept the feed chute latches 210. As best shown in FIG. 2B, the plate includes two recesses 330 that match the curvature of the weapon's guide lips 110. As best shown in FIG. 2C, the recesses 330 include a lip 340 at the top of the plate 300, which prevents the plate from slipping off the firearm 100 due to vibration and gravity. Also shown in FIG. 2C, the adapter 300 includes bores 350 for receiving spring pins to prevent the plate from rising due to vibrations during operation of the firearm 100 by capturing the guide lips 330 in the recesses 330.

Figure 3A:
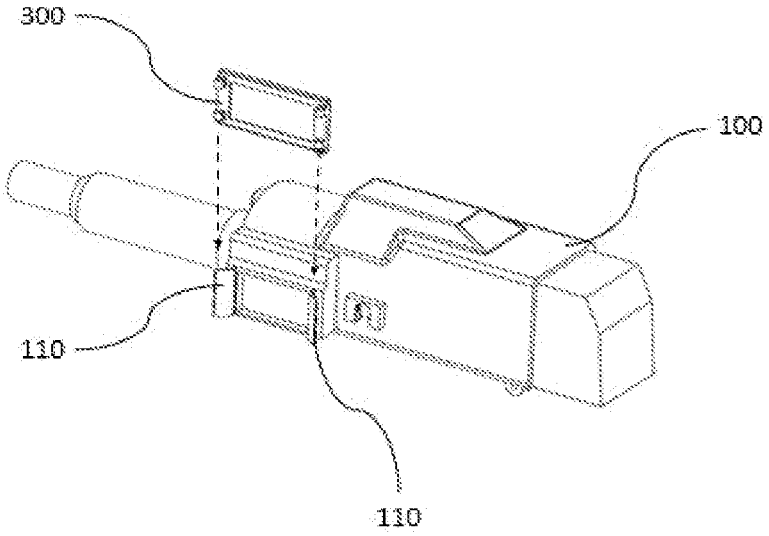
FIGS. 3A-C show how the adapter is installed on firearm 100.
Figure 3B:
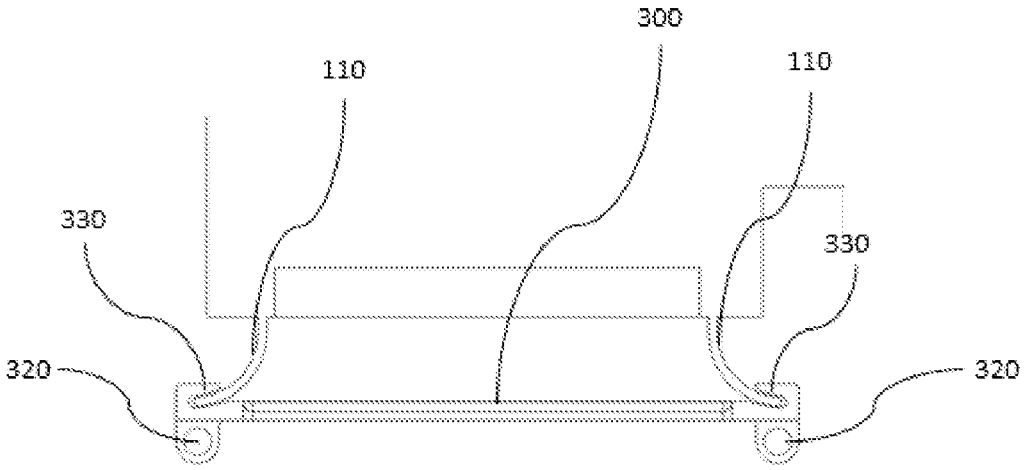
Figure 3C:
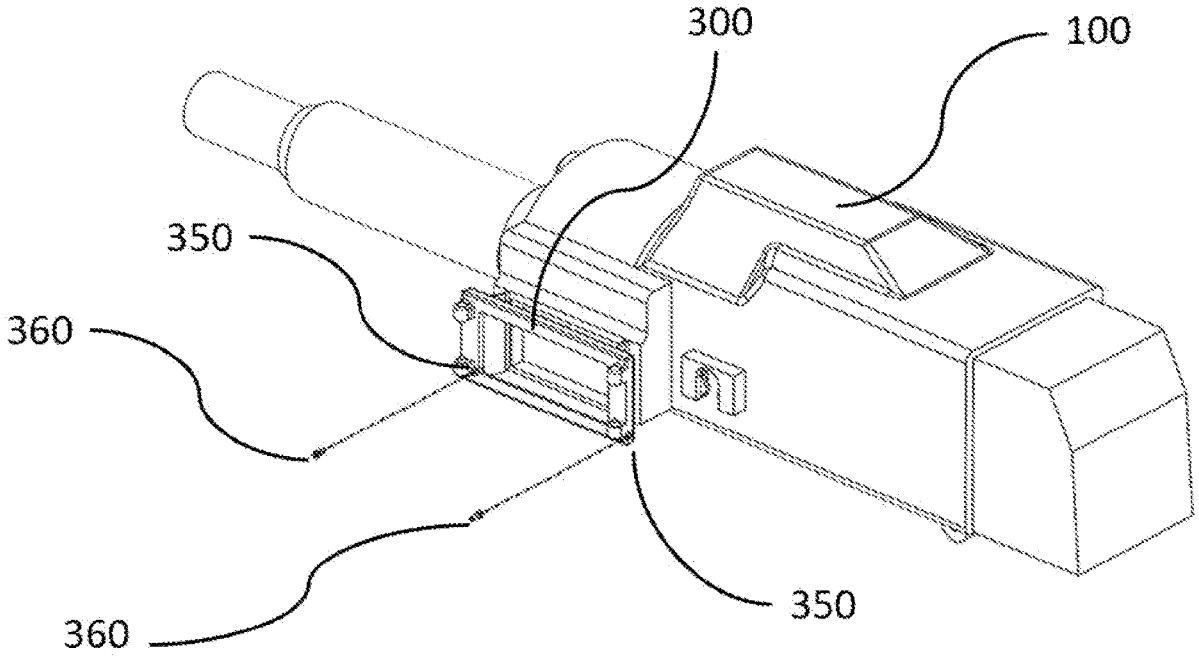

FIGS. 3A-C show the method of installing the adapter 300. Initially, as shown in FIG. 3A, the adapter 300 is slid on to the guide lips 110 of the firearm 100. As shown in FIG. 3B, guide lips 110 are captured by the recesses 330 once the adapter 300 is slid in place. As further shown, the recesses are transverse to the ammunition feed direction. As shown in FIG. 3C, a pair of pins 360 are driven into bores 350 to fix the adapter 300 in place. In some embodiments, the pins may be any type of fastener including but not limited to pins, spring pins, screws, rivets, and studs. As shown in FIG. 1B, once the adapter 300 is held in place, the feed chute latches 210 are attached to the adapter 300 at bosses 320.

The Feed Chute Adapter 300 offers a way to connect a flexible feed chute 200 directly to a firearm 100. No modifications to the firearm 100 are required, and the adapter 300 can easily be installed by trained armorers. The device is simple and economical to produce using additive manufacturing methods. The adapter may be manufactured from various materials including but not limited to aluminum, aluminum alloys, high performance plastics, stainless steel, and nylon. Note that the flexible feed chute 200 is required for turret applications where the ammunition supply is far from the firearm 100, and the relative angle between the gun and the feed route changes significantly as the turret moves through its range of motion.

The feed chute adapter is applicable multiple weapon platforms. The current application is the MK47 40 mm Grenade Machine Gun.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An adapter for a belt fed firearm, the adapter comprising:

a plate;

a cutout in the plate that allows ammunition to pass through the plate;

a plurality of recesses for receiving a plurality of guide lips fixed to the firearm; and a plurality of bosses for receiving a plurality of latches fixed to a feed chute.

2. The adapter of claim 1, wherein the plurality of bosses is four bosses.

3. The adapter of claim 1, wherein each of the recesses further comprise a lip at an upper portion of the recess to prevent the adapter from sliding off due to vibration and gravity.

4. The adapter of claim 1, wherein the plate further includes a plurality of bores, each bore adapted to receive a fastener to prevent the adapter from lifting off of the guide lips.

5. The adapter of claim 4, wherein the fasteners are selected from a group comprising pins, spring pins, screws, rivets, and studs.

6. The adapter of claim 1, wherein the adapter is manufactured from a group comprising aluminum, aluminum alloys, high performance plastics, stainless steel, and nylon.

7. The adapter of claim 1, wherein the adapter is designed for compatibility with a flexible feed chute for turret-mounted firearm applications.

8. The adapter of claim 1, wherein the recesses are transverse to the ammunition feed direction.

9. The adapter of claim 8, wherein the one-piece plate is manufactured using additive manufacturing.

10. A method of attaching a flexible feed chute to a firearm without modifications to the firearm, the method comprising:

sliding a pair of recesses of an adapter onto a pair of guide lips fixed to the firearm, wherein the adapter includes a plate and a cutout in the plate that allows ammunition to pass through the plate; and securing the guide lips in the adapter; and attaching a feed chute to a plurality of bosses fixed to the adapter.

11. The method of claim 10, wherein the guide lips are secured using a pair of fasteners.

12. The method of claim 11, wherein the fasteners are selected from a group comprising pins, screws, rivets, and studs.

13. The method of claim 12, wherein the pin is a spring pin.

14. The method of claim 10, wherein the plurality of bosses is four bosses.

15. The method of claim 10, wherein each of the recesses further comprise a lip at an upper portion of the recess to prevent the adapter from sliding off due to vibration and gravity.

16. The method of claim 10, wherein the plate further includes a plurality of bores, each bore adapted to receive a pin to prevent the adapter from lifting off of the guide lips.

17. The method of claim 10, wherein the adapter is manufactured from aluminum.

18. The method of claim 10, wherein the adapter is designed for compatibility with a flexible feed chute for turret-mounted firearm applications.

19. The adapter of claim 10, wherein the pair of recesses are transverse to the ammunition feed direction.

* * * * *